US007043953B2

(12) United States Patent
Engel

(10) Patent No.: US 7,043,953 B2
(45) Date of Patent: May 16, 2006

(54) X-H ROLLING METHOD FOR PARALLEL-FLANGE STEEL SECTIONS (SUPPORTS)

(75) Inventor: Georg Engel, Düsseldorf (DE)

(73) Assignee: SMS Meer GmbH, Monchengladbach (DE)

( * ) Notice: Subject to any disclaimer, the term of this patent is extended or adjusted under 35 U.S.C. 154(b) by 22 days.

(21) Appl. No.: 10/484,601

(22) PCT Filed: Jul. 17, 2002

(86) PCT No.: PCT/EP02/07941

§ 371 (c)(1),
(2), (4) Date: Mar. 2, 2004

(87) PCT Pub. No.: WO03/011488

PCT Pub. Date: Feb. 13, 2003

(65) Prior Publication Data

US 2004/0221636 A1 Nov. 11, 2004

(30) Foreign Application Priority Data

Jul. 21, 2001 (DE) ..... 101 35 601

(51) Int. Cl.
*B21B 41/06* (2006.01)

(52) U.S. Cl. ..... 72/229; 72/200; 72/201; 72/202; 72/225; 72/235; 72/236; 72/238; 72/365.2; 72/366.2

(58) Field of Classification Search ..... 72/200, 72/201, 202, 225, 229, 235, 236, 238, 365.2, 72/366.2

See application file for complete search history.

(56) References Cited

U.S. PATENT DOCUMENTS 4,637,241 A * 1/1987 Michaux ..... 72/225
5,896,770 A * 4/1999 Hioki et al. ..... 72/229
5,966,977 A * 10/1999 Engel et al. ..... 72/201

* cited by examiner

*Primary Examiner*—Derris H. Banks
*Assistant Examiner*—Hung C Le
(74) *Attorney, Agent, or Firm*—Andrew Wilford

(57) ABSTRACT

A method of X-H rolling of a parallel flange steel structural shape or beam with an H cross section using a compact rolling group. In the first universal mill frame the vertical roll have roll surfaces inclined to one another at an angle up to 10° whereas in the second universal mill frame the vertical rolls have cylindrical roll surfaces which divide the H opening cross section with lateral surfaces of the horizontal roll. The structural shape is rolled in the second universal mill frame to up to 100% of the reduction in the first rolling mill frame.

2 Claims, 1 Drawing Sheet

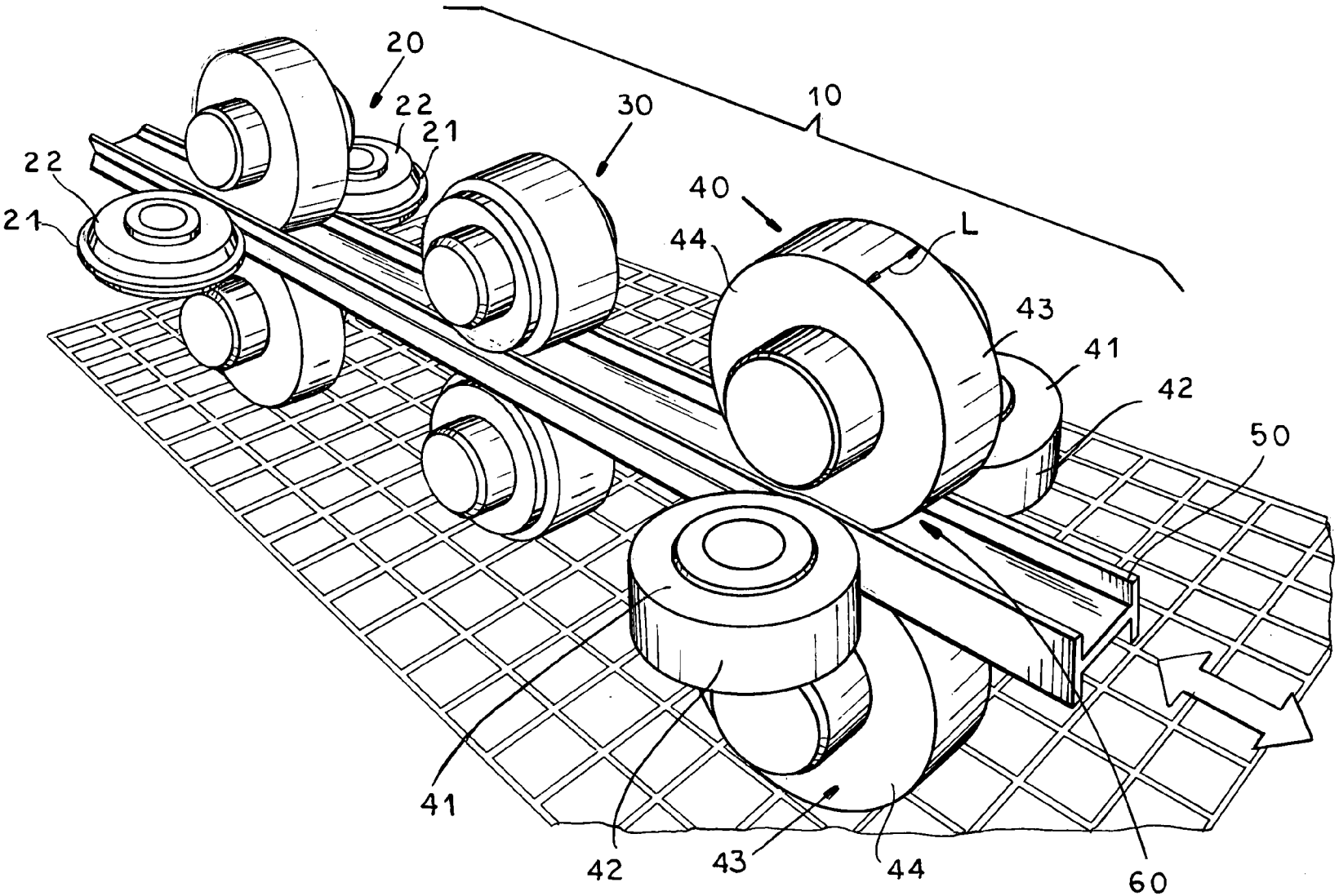
10
20
21
22
30
40
41
42
43
44
50
60
L

X-H ROLLING METHOD FOR PARALLEL-FLANGE STEEL SECTIONS (SUPPORTS)

CROSS REFERENCE TO RELATED APPLICATIONS

This application is a national stage of PCT/EP02/07941 filed 17 Jul. 2002 and based upon German national application 101 35 601.3 of 21 Jul. 2001, under the International Convention.

FIELD OF THE INVENTION

The invention relates to a method for the X-H rolling of parallel-flange steel structural shapes (beams) with an H cross section in a tandem operation in a compact rolling group which is comprised of a first universal rolling mill or universal rolling mill frame, an upsetting rolling mill or upsetting rolling mill frame following the first universal rolling mill and a second universal rolling mill or universal rolling mill frame, following the upsetting mill, whereby the rolls of the frames have rolling surfaces which are inclined or perpendicular to the axes of the rolls.

As raw materials for a pass through such a compact rolling group, either pre-rolled continuous cast material is used, whereby the pre-rolling is effected on a conventional breakdown mill or frame, or the pre-rolling is effected in a vertical-horizontal-reversing rolling group or a horizontal-universal reversing rolling group or a vertical-horizontal-universal reversing rolling group. However, continuously cast, preliminary shaped structural shapes fabricated to near final dimensions (near net shape continuous castings) can be supplied to this compact roll group.

In the rolling of these H structural shapes or H-beams in accordance with this method, especially in the case of heavy beams, drawbacks can arise because of the high wear and the different wear effects upon the rolling surfaces especially in the case of horizontal rolls by comparison with other horizontal mill frames. This wear requires that the rolls be re-turned, that is turned-down or machined anew, and thus contributes to an unacceptable increase in the operating cost.

Experience has indicated that it is advantageous to keep the wear of the horizontal rolls in the first universal mill frame and the wear of the horizontal rolls in the second universal mill frame the same to the highest degree possible so that the subsequent turning of both horizontal roll sets can be carried out simultaneously or at the same point in time, as much as possible, to keep the cost as low as possible and to enable the turning of the bodies of the two roll sets to be as close to one another as possible in order to avoid unnecessarily large losses of material. This matching of the wear properties has been found to be difficult to maintain in practice.

OBJECT OF THE INVENTION

The invention thus has as its object the reduction in the wear of the horizontal rolls which should be matched for the two mill frames with respect to one another and which should be maintained as close as possible, equal to one another.

SUMMARY OF THE INVENTION

This object is achieved with use of vertical rolls with rolling surfaces inclined between 0' and 10' with respect to one another in the first universal mill frame and with vertical rolls with cylindrical rolling surfaces in the second universal mill frame, the lateral surfaces of the horizontal rolls with which the roll surfaces of the vertical rolls form the H caliber or pass or opening cross section, having inclinations of 0.0' to 0.5' and, in the second universal mill frame, a reduction is effected of the rolled material which corresponds to 0 to 100% of the reduction attained in the first universal mill frame.

The outer rolling body lengths of the horizontal rolls of the second universal mill frame can thus advantageously correspond to the inner chamber dimension of the H beam to be rolled.

In the normal case in the application of the method of the invention, the reduction is effected from 100% of the reduction in the first universal mill frame, in a cascade manner in the subsequent passes until at the last pass, a minimum reduction of 5% is selected. It can also be advantageous, based upon the temperature considerations, to provide a pass with very low reduction in the two universal mill frames initially so that then the reduction in the mill frames can be further increased subsequently.

The use of the method according to the invention allows a practically simultaneously re-turning or re-machining of the rolls of both universal mill frames and thus a re-turning of these rolls at a particularly cost effective point in time and, in addition, a reduction in the material losses and thus the overall finishing costs.

The invention claimed is:

1. A method for the X-H rolling of a parallel flange steel structural shape with an H cross section in a tandem operation in a compact rolling group which is comprised of a first universal mill frame, an upsetting mill frame following this first universal mill frame and a second universal mill frame following the upsetting mill frame, whereby the rolls of the mill frames have rolling surfaces which are inclined to the roll axes or are perpendicular to the roll axes, the method comprising:

(a) providing vertical rolls with roll surfaces inclined to one another between about 0· and 10· in the first universal mill frame and rolling the structural shape therein;

(b) providing vertical rolls with cylindrical rolling surfaces in the second universal mill frame;

(c) providing lateral surfaces of the horizontal rolls which form an H caliber or opening cross section with rolling surfaces of the vertical rolls with inclinations of about 0· to 0.5· in the second universal mill frame; and (d) effecting in the second universal mill frame, a reduction of the structural shape which accounts to about 0% to 100% of the reduction in the first rolling mill frame.

2. A device for carrying out the method according to claim 1 wherein the outer roll body lengths of the horizontal rolls of the second universal mill frame correspond to the inner dimensions of the chamber of the H cross section of the structural shape to be rolled.

* * * * *